United States Patent [19]

Tarrant

[11] 4,015,434

[45] Apr. 5, 1977

[54] LEG AND GUIDE CONSTRUCTION FOR USE IN JACKUP BARGES

[75] Inventor: D. Jarratt Tarrant, Houston, Tex.

[73] Assignee: Scandril Offshore, Inc., Houston, Tex.

[22] Filed: Oct. 22, 1975

[21] Appl. No.: 624,719

[52] U.S. Cl. ..... 61/91; 114/265; 254/95

[51] Int. Cl.[2] ..... E02B 17/02

[58] Field of Search ..... 114/.5 D, 45; 61/46.5, 61/90, 91; 115/9; 37/73; 254/95, 97

[56] References Cited

UNITED STATES PATENTS

| | | | |
|---|---|---|---|
| 2,576,928 | 12/1951 | Engstrand | 114/45 |
| 3,398,541 | 8/1968 | Thomas | 114/.5 D X |
| 3,412,981 | 11/1968 | Richardson | 61/46.5 X |
| 3,921,958 | 11/1975 | Brockelsby | 254/97 X |

*Primary Examiner*—Trygve M. Blix
*Assistant Examiner*—Sherman D. Basinger

[57] ABSTRACT

An improved leg construction is disclosed for jackup barges. The barge leg is typically of triangular construction. The members of a leg including the three verticals extending along the leg are preferably constructed of tubular members. The vertical tubular members include on the inside a rack formed of teeth to engage an elevating gear drive unit. Adjacent to the teeth, an undercut on both sides of the slot in the exterior of the tubular member is formed, locking the guide mechanism to the tubular member. This construction measurably improves the profile of the jackup leg to impinging wave action from any direction, thereby reducing the resistance of the leg to water and permitting a reduction in the leg weight and hull size.

6 Claims, 6 Drawing Figures

LEG AND GUIDE CONSTRUCTION FOR USE IN JACKUP BARGES

BACKGROUND OF THE INVENTION

Jackup barges having three legs are customarily used in erecting temporary drilling platforms above the ocean at offshore locations. An offshore drilling barge must be positioned substantially above the level of the water, even higher than the wave action anticipated in a violent storm to enable offshore drilling. The platform normally weighs several million pounds. Normally, it is substantially large typically measuring as much as two hundred feet along a side. The platform is supported on three legs. The legs extend from the platform to a bottom plate which enables them to rest on the mud beneath the body of water. An elevating mechanism lifts the platform on the three legs at the time of elevation. Typically, the barge is towed with the legs raised and the platform floating on the water. At the time of erection, the legs are lowered until they encounter the bottom, and they support the platform as it is raised above the water.

The legs are quite sizable. On a modern rig, the legs may be as much as four or five hundred feet tall. The legs typically are formed of a triangular open lattice work which is as much as fifty feet across. The triangular shape is open and is typically formed of structural members as large as four or five feet thick. Various and sundry types of structural members are used in the construction of jackup legs. Box beams, I beams, flanged plates, and tubular members have been used all to form various and sundry jackup legs. Jackup legs typically must have horizontal beams to reinforce the three corner members. In addition they normally include reinforcing members at angles extending from corner to corner to give rigidity to the entire leg structure. The horizontal beams and the angularly positioned reinforcing members basically tie the three corner members together, thereby defining a structure which is able to support the weight of the drilling barge.

It is necessary for the platform to include equipment which lifts the platform on the jackup legs. Many types of equipment have been suggested including devices which insert pins into holes in the legs, rack and pinion mechanisms and the like. The leg thus must necessarily be constructed with a mechanism extending along its length for engagement with the lifting mechanism and this typically includes at least a set of holes or a rack. Typically, the rack or the holes must be aligned with the mechanism on the platform and to this end, appropriate flanged plates or alignment members are incorporated. The rack and alignment members are typical devices known previously are necessary.

Constructions used in the past have further required additional strength in that they have to be formed with exposed racks and appropriate alignment flanges. While these may impart vertical strength and otherwise serve as support columns enabling the platform to be raised on the leg, they have an unfavorably shaped profile presented to the water. The profile of the leg in the water is very important. Ordinarily, the leg is an open lattice work. This enables waves to pass through the leg. Nevertheless, the leg is not simply transparent to wave action. The tendancy of the leg to bend under wave impact is proportional to a factor determined by the streamlining of the leg as viewed from any direction. It is not possible to know in advance the direction from where waves originate. Accordingly, the three legs of a jackup barge must all be designed to have a required resistance to bending in all directions. That is to say, it is not possible to know in advance the direction of the wave action and additionally to know the precise azimuthal positioning of the drilling rig relative to the wave action. Accordingly, the leg of the drilling rig must all resist bending in all directions around the compass. Further, the profile of the leg or the streamlining as viewed in any particularly direction must be made optimum. The most optimum arrangement is a circular frame member at each corner of the leg. This construction presents the minimum resistance to wave action without regard to the direction of impingement. However, it is well neigh impossible to use a circular frame member because the leg must incorporate a rack and appropriate guides to enable the platform elevation equipment to operate. Some jack-up rig designs include vertical racks attached to legs made of circular stock. The rack presents an irregularity in shape to the wave action and detracts from the streamlined shape of the circular leg. A circular leg is difficult to use with as a guide because it does not provide an edge for grasping. If the guide fits around the entire leg, the leg must be built to rather expensive tolerances. Accordingly, the present invention has been devised.

This device enables the use of circular stock in the three corners of the triangular legs. This reduces the profile of the completed legs to a minimum, thereby reducing the bending which occurs in wave action and further increasing the strength of the leg. This results in a reduction of metal in the leg. In a representative leg for a full size drilling rig, the leg might weigh as much as six million pounds if constructed in accordance with teachings of the prior art. Incorporating the leg construction of this disclosure, a reduction of one million pounds or more of metal in the leg is possible. The reduction of bending moment reduces the design criteria in the hull itself, thereby reducing the weight and cost of the hull. The overturning moment is also reduced which allows closer spacing of the legs of a smaller hull. This reduces the cost of construction, increases the speed of towing, increases the bending resistance, and otherwise provides a more efficient platform design. As a consequence, the rack for cooperation with the elevation equipment and the guides which provides positive engagement therewith are recessed in the circular cross section of the corner members of the leg to thereby provide an optimum reduction in profile.

SUMMARY OF THE INVENTION

This invention is for use in jackup barges typically having three legs where each leg is formed of a set of three vertical corner members. The three vertical members are each constructed in accordance with the teachings hereof. Each one is formed of circular stock. Each one has on the inside a vertical rack with teeth formed for engagement by elevation equipment carried on the platform. A vertical slot is formed in the circular members of a specified width and an undercut on both sides is formed to enable a walking guide mechanism to be inserted. The undercuts are adjacent to the teeth of the rack.

DESCRIPTION OF THE PREFERRED EMBODIMENT

Figure 1:
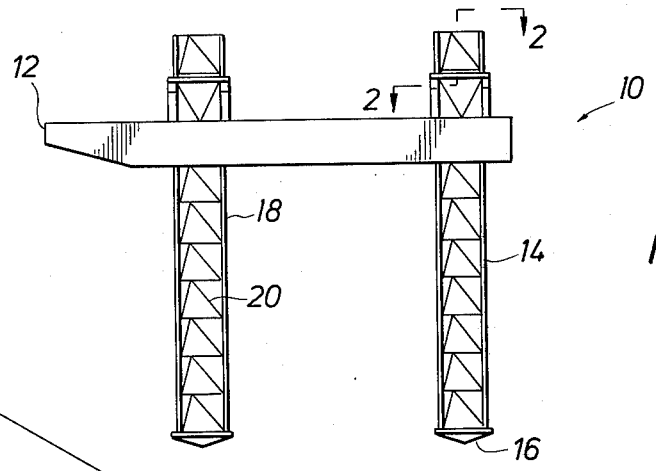
FIG. 1 is a side view of a jackup barge which is raised on open framework legs in accordance with the teachings with this invention.

Attention is directed to FIG. 1 of the drawings. In FIG. 1, a jackup platform for supporting a drilling rig is shown at 10. A floatable hull or platform 12 is included. It floats on the water when it is being towed. When the drilling rig 10 is located at the desired location, the legs 14 are lowered until the bottom plate 16 rests on the bottom. The process is continued, thereby raising the platform 12 above the water. It is typically raised 50 or 60 feet above the normal level of the water to be positioned high above the wave action on the water. When this occurs, the weight of the entire drilling rig is supported on the legs. There are typically three legs arranged in the triangle.

Each of the legs 14 are normally similar. A typical construction is an arrangement whereby the leg 14 includes three members arranged approximately equidistance from one another to define an equilateral triangle. They may be positioned as much as 50 feet apart. In this invention, the leg 14 is preferably formed of circular stock at each corner. The three corner members typically will range as large as four or five feet in diameter. They are joined together by various beams 18 and angle braces 20. The number, size, and location of the beams 18 or the braces 20 is of no particular concern to this disclosure. Rather, this disclosure is directed to the three typical corner members which extend vertically on the leg 14. These are the major structural supports. As the major structural supports, they carry the weight of the drilling rig 10. Moreover, when constructed as taught by this disclosure, they are able to withstand tremendous bending forces as result of the waves which strike the drilling rig 10.

Figure 2:
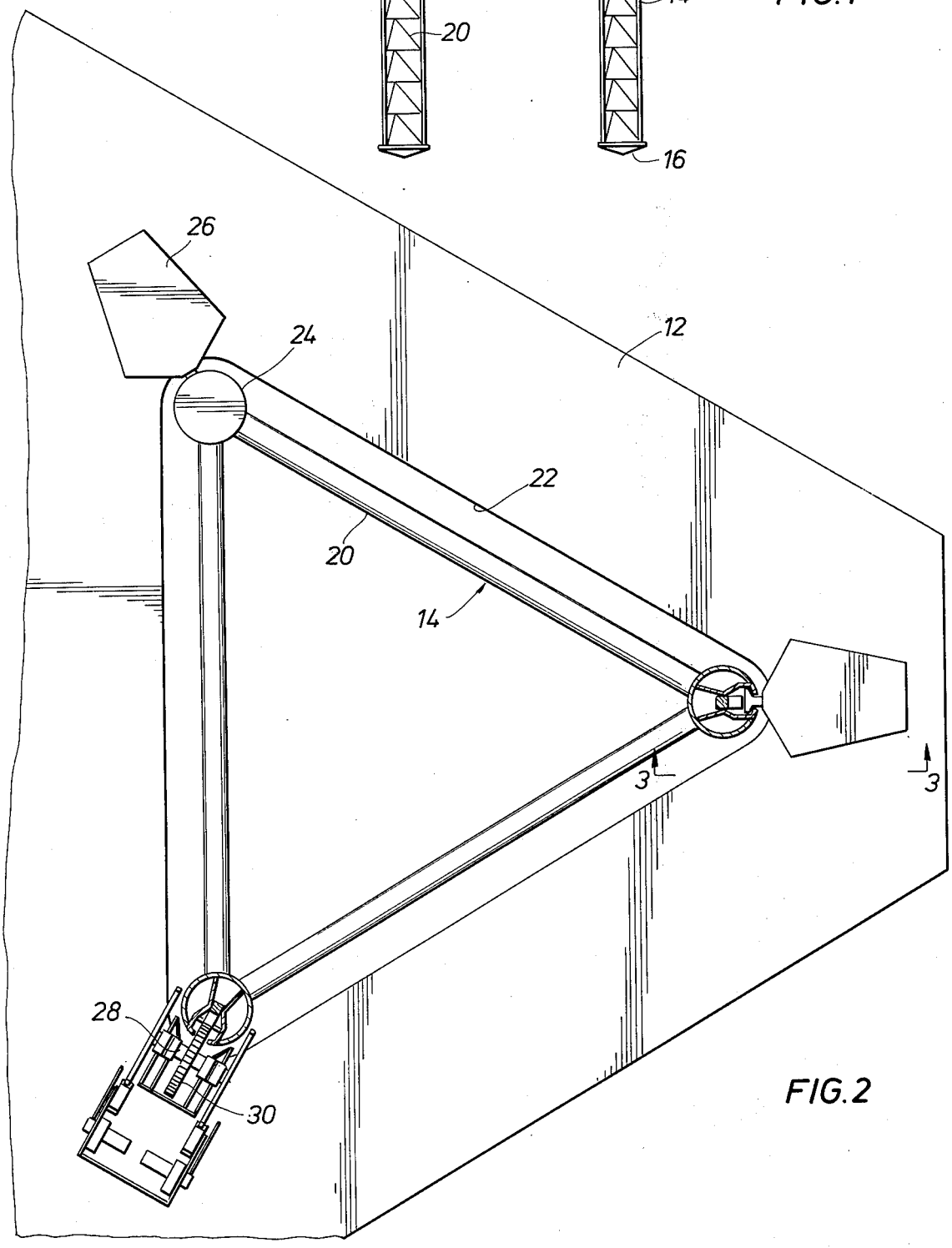
FIG. 2 is a sectional view along the line 22 of FIG. 1 showing a triangular leg constructed in accordance with the teachings of the present invention cooperative with elevation equipment carried on the platform.

In FIG. 2 of the drawings, a portion of the barge 12 is shown. The leg 14 extends through an opening in the barge 12. The opening 22 is approximately triangular to match the shape or cross section of the leg 14. The leg 14 includes several beams 20 which extend between the major structural members located at the corners of an equilateral triangle, the numeral 24 identifying the vertical members. The three vertical members are all preferably identical. That is, they are of equal strength, equal size, and are all meshed with the guide mechanism for use in the alignment of the leg with the platform 12.

As shown in FIG. 2, the leg 14 is thus formed of three major vertical frame members 24. They support the load placed on the leg. An elevation device is indicated at 26. Preferably, one is located in each corner of the leg to cooperate with each of the vertical members 24. One is shown with the top removed in FIG. 2 to disclose a shaft 28 which supports a drive gear 30. The gear 30 extends through a slot and engages a vertical rack to lift the leg 14. This will be described in detail hereinafter.

Figure 3:
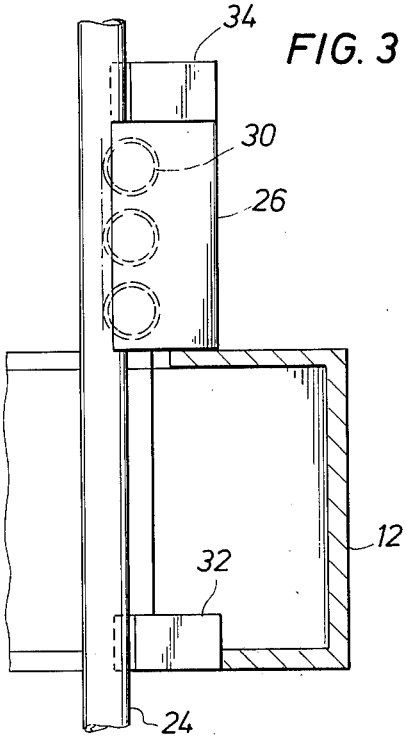
FIG. 3 is a sideview of the elevation equipment including a plurality of pinions engaged with a rack recessed within the circular leg construction of the present invention.
Figure 4:
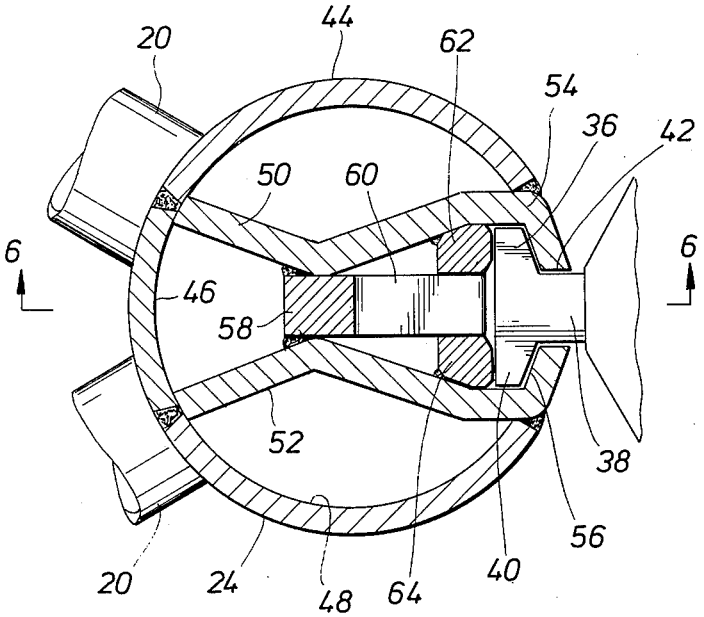
FIG. 4 is a sectional view through the circular leg construction of the present invention showing an internal rack and adjacent undercuts by which a guide mechanism is inserted in the leg to secure it relative to the platform.

In FIG. 3 of the drawings, the platform 12 is illustrated. It is typically a closed vessel to enable it to float on the water when under two. The bottom of the hull incorporates a lower guide mechanism 32 and an upper guide mechanism 34 is carried on the elevating apparatus 26. They are similar in construction and differ in location. Each one incorporates a tee shaped protruding guide member 36 shown in FIG. 4. It has a somewhat narrow neck 38 and protruding ears at 40. The ears are symmetrical and protrude on each side, thereby forming a locking guide which fits within an appropriate shaped internal vertical slot of the corner member 24. The leg member 24 is provided with a vertical slot 42 extending vertically along its exposed side. The sectional view of FIG. 4 shows reinforcing beams 20 connected at one side of the apparatus and the slot is located oppositely of them considered jointly. This exposes the slot for easy cooperation with the guide mechanisms 32 and 34. Each of the guide mechanisms 32 and 34 incorporates the tee shaped guide 36. It extends into the slot 42 and is wider, thereby locking the guide 36 into position.

The member 24 is constructed of circular stock. This is shown in FIG. 4 where a first segment 44 is welded to a second segment 46 and a third curved segment 48 is opposite the segment 44. These join together to substantially define the exterior of the circular structure. The gap which is left on the right hand side of FIG. 4 is substantially closed by plates which are rolled into the profile shown. The shaped plates include the one shown in 50 and the symmetrical plate 52, the two formed identically but being mirror images of one another. They are welded at the left hand edges at the welds which are common for the external segments 44, 46, and 48. In particular, they terminate at curved exposed portions 54 and 56 which portions are on the exterior of the circular member 24 thereby defining a portion of the circular surface and further defining the vertical slot 42 for insertion of the guide 36.

Figure 6:
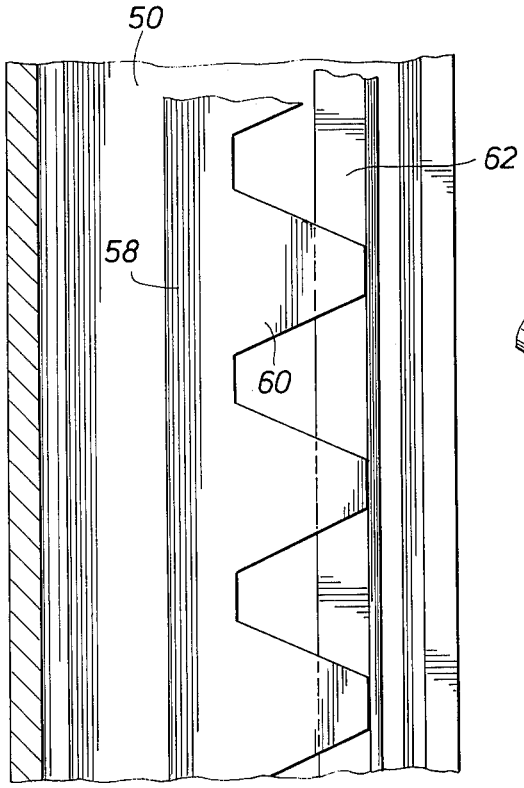
FIG. 6 is sectional view along the line 6—6 of FIG. 4 showing the rack on the interior of the leg.

The shaped plates 50 and 52 are joined to the base 58 of a rack 60. The rack 60 has protruding teeth as better shown in FIG. 6. The base 58 is a member extending the length of the circular member 24. The base 58 is preferably welded to the plates 50 and 52. This anchors it in location. It is of substantial stock to enable it to support the load without shearing the teeth from the rack 60. The teeth 60 extend toward the slot 42. The teeth 60 are provided with lateral support on both sides by incorporation of the shaped beads 62 and 64 on each side. The beads are identical in profile or crossection. The beads 62 and 64 are welded to the shaped plates 50 and 52 and are parallel to the rack 60. They abut the teeth 60 on the rack and provide lateral support. Moreover, they define a bearing surface which prevents the guide 36 from extending to deeply into the slot 42. The guide 36 is thus captured by the beads 62 and 64 and is not permitted to contact the crown of the teeth. Clearance is shown in FIG. 4 between the guide 36 and the teeth of the rack.

The internal construction of the circular member provides substantial strength. The member 24 is substantially strong as a result of the manner in which the components are assembled. The base of the rack, for instance, imparts additional vertical strength to the structure. The base serves as a vertical reinforcement member. The shaped plates 50 and 52 increase the resistance of the member 24 against bending. They also cooperate to define the vertical rack when assembled and the undercut slot 42 to enable the guide 36 to hold the member at a specified location.

Returning to FIG. 3 of the drawing, the guide supports 32 and 34 each incorporate a guide as described with reference to FIG. 4. When the leg 14 is in position relative to the platform 12, the guide mechanisms 32 and 34 secure the leg at the required position. This enables the elevating mechanism 26 to engage the leg and raise or lower the platform 12 relative to the leg. The elevating mechanism preferably incorporates the drive gear 30 which extends into the slot and engages the rack in the member 24. Preferably, the elevating mechanism 26 includes two or three drive gears which are spaced apart, each of which has teeth which match the teeth on the rack 60. The drive gears 30 are driven in unison. Thus, the circular member 24 is held at the requisite location to enable the drive gears to engage the leg and raise or lower the leg as the case may be.

The leg of the present invention thus transfers the raising and lowering movement from the elevating mechanisms 26 to the leg 14. This enables the platform 12 to be raised or lowered. This assures that the leg is held in the necessary position for this operation.

Figure 5:
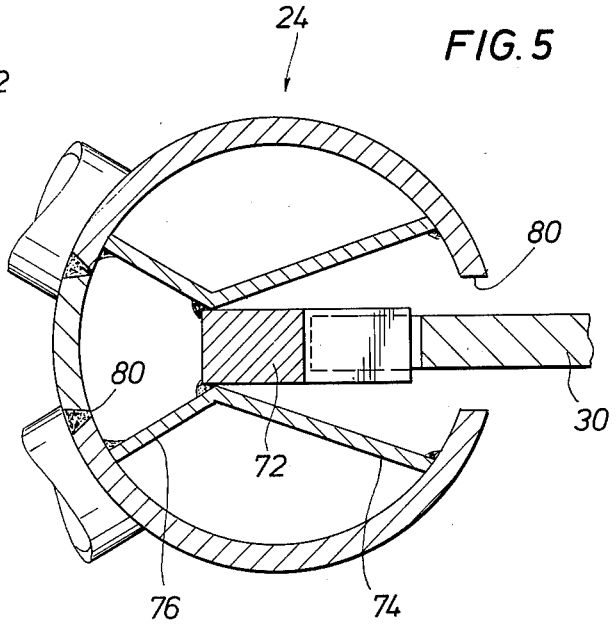
FIG. 5 shows an alternative embodiment to that of FIG. 4.

FIG. 5 discloses an alternative form. The circular member 24 is the same on the exterior but is constructed differently on the interior. The version as shown in FIG. 4 is formed of shaped plates. The version shown in FIG. 5 is preferably formed of shaped plates. The numeral 72 identifies a casting which has the base and the teeth of the rack (optionally along both faces of the rack) integrally formed and joined to a pair of angled plates 74 and 76. They position the castrack internally of the circular member. Moreover, they provide strength against bending. The casting 72 thus is fixed in position by the reinforcing gussets 74 and 76 duplicated on both sides. It is similar in that it includes the exposed slot 80 with the appropriate under cuts for enabling the drive gear 30 to engage the teeth. The slots 80 are duplicated to enable the rack to be engaged from both sides, i.e., by a dual leg elevation system. The dual slots are optional, not mandatory. Each slot is able to receive a guide in it.

The leg is aligned with the guides 36. The upper or lower end of the leg is made clear of obstructions so that the tee shaped guide 36 can be inserted into the slot. It is captured and constrained to movement only in the vertical direction. The elevating mechanisms 26 at each corner must run at the same rate and to this end, they are preferably driven from a common source and are otherwise provided with common drive rates. To this end, the drive gears 30 are preferably identical in size and are rotated at the same speed. A suitable motor is preferably connected to each one to rotate it, typically by installing a motor in the elevating equipment 26 which has an output shaft engaged with the drive gear 30.

The difference in the embodiments of FIGS. 4 and 5 is more a difference in construction technique, the strength of the structures being approximately the same. The two embodiments have in common the incorporation of an internally reinforced vertical member having the slot on the exposed side adjacent to the internal rack and the undercut guideway for the guide 36.

The guide 36 is tee shaped; it will work equally well if it has an added laterally directed plate parallel to the skin of the leg member and on the outside of the column. Thus the guide clamps the skin at the edge of the slot means.

When the leg 14 is in the water, the circular member 24 has the most streamlined shape possible and hence, the amount of metal required for the leg 14 is reduced to obtain strength against a specified wave action in the leg. This is particularly helpful in reducing the total weight of the leg and hence the cost of fabrication. The slot 42 does not create any particular problem with wave action. Even if the waves impinge directly on the slot, the slot is relatively narrow, and for all intents and purposes, it does not materially deviate from the streamlined shape obtained by the circular cross section of the member 24. As a consequence, the invention provides the most possible streamlined shape without regard to the direction of propogation of the waves acting against the leg 14.

The foregoing is directed to the preferred embodiment of this invention but the scope thereof is determined by the claims which follow.

I claim:

1. For use in a leg of a jack up rig for use in off shore oil well drilling operations, a vertical frame member adapted to be positioned at a corner of the leg and further adapted to cooperate with a guide means on the rig, the frame member comprising:

an elongate structural member of circular cross section which includes a parallel slot means on the exterior thereof, said slot means having a width sufficient to enable insertion of a guide means supported by a jack up rig into the slot means and having a length at least equal to the desired length of travel of the leg relative to the rig;

an undercut adjacent to said slot means which extends parallel thereto for locking a guide means therein which guide means has a neck and a wider portion supported by the neck and wherein said undercut and said slot means are profiled to match the profile of the guide means;

a rack of teeth supported by said structural member on the interior of said elongate structural member and facing said slot means, said slot means and said teeth forming a means for receiving a drive gear inserted into the teeth for imparting axial movement to said structural member; and wherein the circular cross section surrounds said rack which is joined thereto by means positioned axially of said structural member and joined to said rack.

2. The apparatus of claim 1 wherein said rack has a lengthwise base with teeth along one side thereof, and including right and left protective means adjacent to said teeth and positioned to shield said teeth from snagging on the guide means of the rig.

3. The apparatus of claim 2 wherein said protective means are parallel to said rack and are located closer to said slot means in comparison to said teeth.

4. The apparatus of claim 1 wherein said circular cross section is defined by lengthwise and parallel shaped plates, at least two in number which join to define the exterior and which terminate in adjacent parallel edges which define said slot means.

5. The apparatus of claim 4 including a symmetrical undercut adjacent to said slot means.

6. The apparatus of claim 1 wherein said slot means includes a pair of spaced edges which are a part of a circular outer skin on said member and said edges overhang an adjacent clear area which overhang defines an undercut wider than said slot means.

* * * * *